United States Patent [19]

Walter

[11] Patent Number: 4,892,029

[45] Date of Patent: Jan. 9, 1990

[54] POSITIONING DEVICE

[75] Inventor: John Walter, Evergreen Park, Ill.

[73] Assignee: Continental Can Company, Inc., Norwalk, Conn.

[21] Appl. No.: 207,506

[22] Filed: Jun. 16, 1988

[51] Int. Cl.[4] ..... F01B 3/00; F01B 15/00

[52] U.S. Cl. ..... 92/51; 92/117 A; 53/276; 74/57; 198/471.1; 198/478.1

[58] Field of Search ..... 92/2, 31, 51, 117 R, 92/117 A, 146, 147, 54, 56; 74/57; 53/272, 276, 278, 279, 280; 198/468.01, 468.2, 472.1, 474.1, 476.1, 477.1, 478.1, 482.1, 483.1, 803.9

[56] References Cited

U.S. PATENT DOCUMENTS 2,359,433 10/1944 McNamara ..... 198/474.1 X
2,468,255 4/1949 Dunn ..... 198/474.1 X

FOREIGN PATENT DOCUMENTS 1172705 6/1964 Fed. Rep. of Germany ..... 92/146

*Primary Examiner*—Robert E. Garrett

*Assistant Examiner*—Mark A. Williamson

*Attorney, Agent, or Firm*—Charles E. Brown; Paul Shapiro; Charles A. Brown

[57] ABSTRACT

This relates to a positioning device for positioning a member relative to a work piece. In the preferred use of the positioning device, a sealing head is carried by the positioning device with the sealing head having a first lowered position for picking up a lid for a container and a second lowered position for positioning the lid and thereafter bringing the lid into pressure engagement with an associated container and effect the heat sealing of the lid to the container. The positioning device includes an extensible fluid motor of the piston and cylinder type which is mounted within a guide sleeve for selective vertical positioning by way of a cam follower and cam track and which extensible fluid motor is further selectively extensible so as to further move an associated member carried thereby downwardly and into resilient clamping engagement with the work piece.

14 Claims, 2 Drawing Sheets

POSITIONING DEVICE

This invention relates in general to new and useful improvements in positioning devices, and more particularly to a positioning device having a two step operation wherein in the first step, a member carried by the positioning device is moved towards a work piece or the like and in the second step the member is forced into pressure contact with the work piece.

The invention particularly relates to a positioning device for positioning a sealing head relative to a container for the purpose of forming a bond carried by the sealing head and the container in a manner more specifically disclosed in a copending application.

In accordance with this invention there will be provided a rotating mounting plate which rotates relative to a fixed circular cam and wherein there is carried by the mounting plate a plurality of the positioning devices. For descriptive purposes, only one positioning device will be disclosed.

The mounting plate will be provided with a plurality of through openings and associated with each of the openings will be one of the positioning devices. Each positioning device includes a guide sleeve in which there is mounted for axially movements an extensible fluid motor of the piston and cylinder type for axially movement. A fluid motor will be provided at its upper end with an adapter which carries a cam follower and the cam follower will be engaged with the circular cam so as to move the fluid motor up and down in accordance with the requirements of the machine of which the positioning device is a part.

In addition, the fluid motor, will be selectively extensible by the emission of a fluid to the cylinder thereof. Thus a movable shaft, in the form of a piston rod, of the fluid motor will be extendable and retractable in addition to the movement of the fluid motor per se.

Inasmuch as the positioning device is intended to position a sealing head or the like relative to another component and a work piece, it is to be understood that the fluid motor must be very stably mounted relative to the guide sleeve. Accordingly, there is provided a bushing between the fluid motor and the guide sleeve. The guide sleeve is mounted for movement both with respect to the guide sleeve and the fluid motor by connecting the guide sleeve to the piston rod for movement therewith.

In order that there may be accuracy in the mounting of the fluid motor within the guide sleeve, opposite ends of the fluid motor are provided with spacers which engage the bushing while opposite ends of the guide sleeve are also provided with spacers which engage the bushing.

In order to facilitate the mounting of a supply unit, which is the subject of another copending application, there is provided a supply tube which is guided in another opening in the mounting plate. The supply tube is carried by a support plate, which in turn, is carried by the piston rod. The support plate is provided with means for the detachable mounting of a member and also for the detachable mounting of a supply unit. The supply tube, which has gas and electric lines extending therethrough, also serves to prevent rotation of the support plate as well as the piston rod about the axis of the piston rod.

Other advantages and characteristics of the invention will appear upon a reading of the following descripton given purely by way of illustration and example, with reference to the accompanying drawings, in which.

Figure 2:
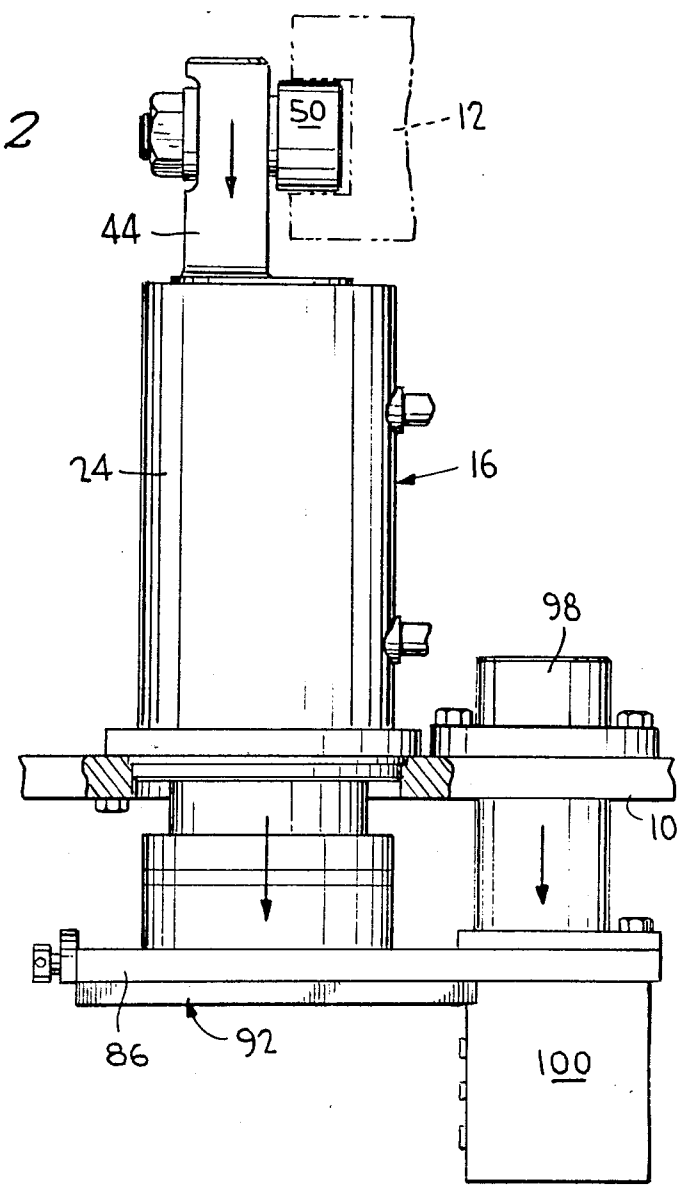
FIG. 2 is an elevational view similar to FIG. 1 and shows the cam operative to move the extensible fluid motor and the mounting means carried thereby downwardly with respect to the mounting plate and the guide sleeve.
Figure 1:
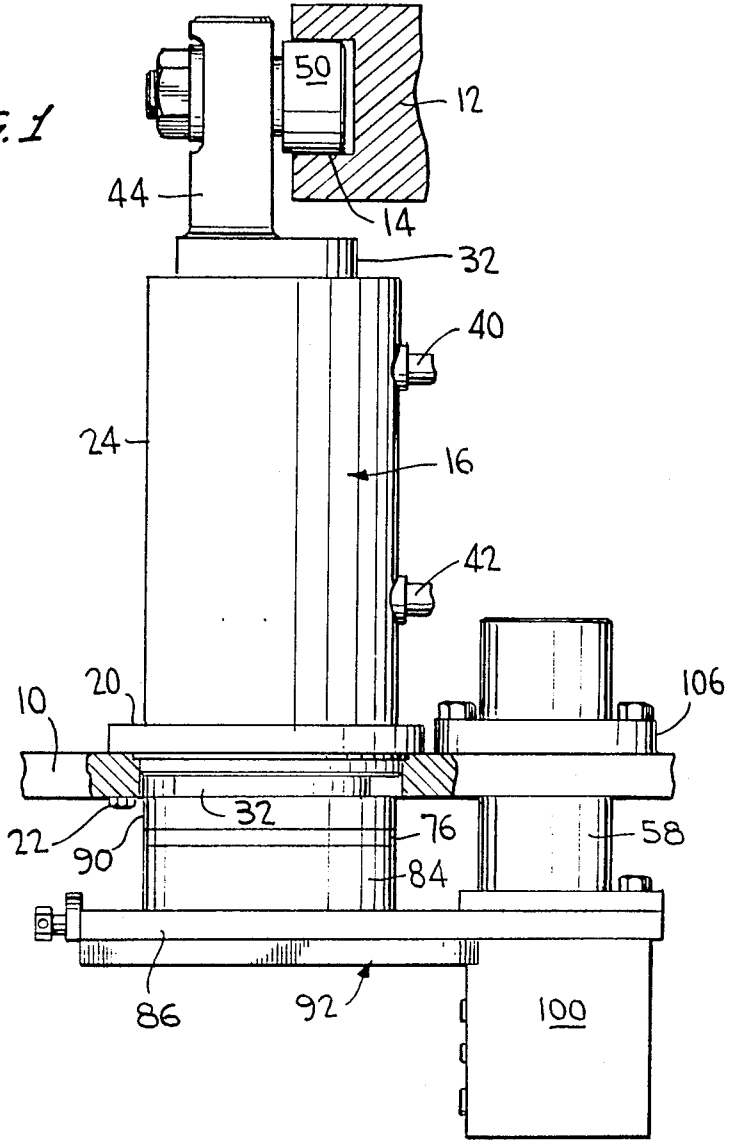
FIG. 1 is an elevational view of the positioning device with the associated mounting plate and cam being broken away and shown in section.

Referring now to the drawings in detail, reference is first made to FIG. 1 wherein there is illustrated the general environment of the positioning device which is the subject of this invention. It is to be understood that the mechanism of which the positioning device is a part includes a mounting plate 10 which is mounted for rotation about a vertical axis by means which in no way form a part of the invention. The mechanism also includes a fixed cam 12 positioned above the mounting plate 10 and having a circular cam track 14. The mounting plate 10, in accordance with a preferred embodiment of the invention, will carry a plurality of the positioning devices, each defined by the reference numeral 16 with the positioning devices being disposed in circumferentially spaced relation. Only one such positioning device 16 is specifically illustrated and described herein.

Figure 3:
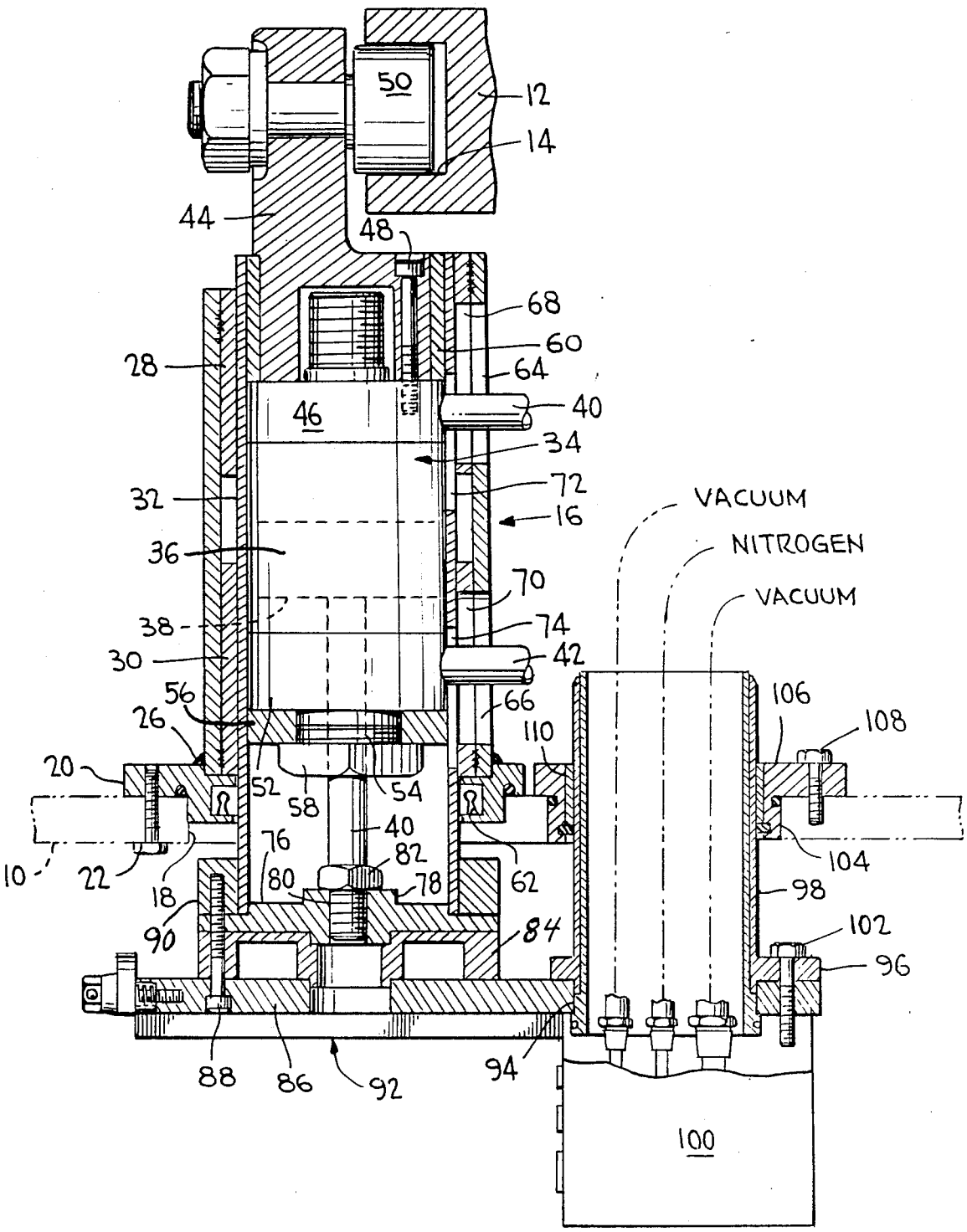
FIG. 3 is an enlarged vertical sectional view taken through the center of FIG. 1 and shows specifically the details of the positioning device.

Referring now to FIG. 3, it will be seen that the positioning device 16 is centered relative to an opening 18 through the mounting plate 10. A mounting ring or collar 20 is seated in the opening 18 and is removably secured thereto by means of fasteners 22 of which only one is illustrated.

An upstanding guide sleeve 24 is carried by the ring 20 and is preferably fixedly secured thereto by welding as at 26.

The guide sleeve 24 is provided with internal spacers including an upper spacer 28 and a lower spacer 30. The spacers 28, 30 have accurately machined internal surfaces and are secured to the interior of the guide sleeve 24 in vertically spaced relation by welding although other securing means may be utilized.

A bushing 32 is vertically slidably mounted in the spacers 28, 30. An extensible fluid motor 34 is mounted within the bushing 32 for relative vertical movement. At this time, it is pointed out that the extensible fluid motor 34 is of the piston and cylinder type including a cylinder 36 in which there is slidably mounted a piston 38. The piston 38 carries a movable shaft in the form of a piston rod 40.

It is to be understood that the fluid motor 34 is of a conventonal construction and is a purchased item. Further, it is to be understood that the fluid motor 34 is of the double acting type and, therefore, there is connected to the cylinder 36 adjacent the upper and lower ends thereof fluid lines 40, 42. It is to be understood that the fluid motor 34 is illustrated in a partially extended position in FIG. 3.

The upper end of the cylinder 36 is provided with an adapter member 44 which is secured to an upper head 46 of the cylinder 36 by means of suitable fasteners 48 of which only one has been illustrated. The adapter or extension 44 is provided with a conventional cam follower 50 which engages the cam surface 14.

The cylinder 36 is also provided with a lower head 52 having an externally threaded extension 54 through which the piston rod 40 extends. A spacer 56 having an external diameter slightly greater than that of the cylinder 36 is clamped to the lower head 52 by means of a nut 58 which is threaded on to the extension 54.

At this time it is also to be noted that the adapter 44 has a cylindrical spacer 60 mounted thereon. The external dimension of the spacer 60 is the same as that of the spacer 56.

It is to be noted that the bushing 32 is in sliding contact with the external surfaces of the spacers 56, 60 so as to accurately guide the cylinder 36 as it is moved vertically by the cam surface 14.

It is to be understood that the meeting surfaces of the various spacers and the bushing 32 may be lubricated. If so, the adapter ring 20 will be provided with a seal 62.

It is also to be noted at this time that the guide sleeve 24 is provided with vertically spaced, vertically extending slots 64, 66 for receiving the fluid lines 40, 42 so as to permit the vertical movement of the fluid motor 34 within the guide sleeve 24. The spacer 28 is provided with a slot 68 which is aligned with the slot 64 while the spacer 30 is provided with the slot 70 which is aligned with the slot 66. Further, the bushing 32 is provided with vertical slots 72, 74 for receiving the fluid lines 40, 42 respectively.

At the lower end of the movable shaft or piston rod 40, there is provided a circular adapter plate 76 having a hub 78 with an internally threaded bore 80 which is threadly engaged on the lower end of piston rod 40 and is locked in a vertically adjusted position relative to the piston rod 40 by means of a lock nut 82.

A spacer 84 is engaged with the underside of the adapter plate 76 and spaces from the adapter plate 76 a support plate 86. The support plate 86 is fastened relative to the adapter plate 76 by fasteners 88 of which only one is illustrated. Each fastener 88 is threaded into a threaded bore in a mounting ring 90 which carries the lower end of the bushing 32 and thus secures the bushing 32 to the adapter plate 76 for movement with the piston rod 40.

it is to be understood that the support plate 86 carries mounting means 92 which are not a part of this invention, but serve to provide for the quick replaceable mounting of a sealing head in the preferred usage of the positioning device 16.

It is to be understood that the support plate 86 is elongated and extends radially of the mounting plate 10. The support plate 86 has an opening 94 therethrough in which there is seated a mounting ring 96 which carries the lower end of a supply tube 98 which is associated with a supply unit 100 which does not form part of this invention. The mounting ring and the supply unit 100 are coupled together by means of fasteners 102 of which only one is illustrated so as to fix the supply tube 98 and the supply unit 100 relative to the support plate 86.

The mounting plate 10 is provided with a second opening 104 which is disposed radially inwardly of the opening 18. A mounting ring 106 is positioned within the opening 104 and is removably secured to the mounting plate 10 by way of fasteners 108 of which only one is illustrated.

The mounting ring 106 carries a sleeve type bushing 110 in which there is guidably positioned the supply tube 98. It is to be understood that fluid supply lines and electrical lines extend from the supply unit 100 through the supply tube 98.

It is further to be particularly understood that the supply tube 98 werves to position the support plate 86 against rotation relative to the axis of the piston rod 40. Thus the support plate 86 is very accurately positioned relative to the mounting plate 10.

In usage, the support plate 86 will normally be in a fully retracted position as shown in FIG. 1. During the operation of the mechanism of which the positioning device 16 is a part, the support plate 86 will be selectively lowered so as to selectively lower a member carried thereby for various intended purposes. Further, when it is desired to not only position an associated member in a lowered position, but also to further move or lower such member so as to clamp another element, the fluid motor 34 is actuated so as to move the adapter plate 76 downwardly and thus resiliently clamp a member carried by the support plate 86 against a work piece.

Although only a preferred embodiment of the positioning device has been specifically illustrated and described herein, it is to be understood that minor variations may be made in the positioning device without departing from the spirit and scope of the invention as defined by the appended claims.

I claim:

1. A positioning device particularly adapted for positioning and applying a member such as a sealing head, said positioning device comprising a mounting plate having an opening therethrough, a guide sleeve mounted on said plate in centered relation to said opening, an extensible fluid motor mounted within said guide sleeve for movement axially of said guide sleeve, a cam, said cam having a cam surface varying in distance from said said mounting plate, a cam follower carried by said fluid motor and engaged with said cam surface to vary the position of said fluid motor relative to said mounting plate, said fluid motor including a movable shaft, fluid means connected to said fluid motor for selectively extending and retracting said movable shaft independently of the position of said fluid motor relative to said guide sleeve, and mounting means carried by said movable shaft.

2. A positioning device according to claim 1 wherein said fluid motor is of the piston and cylinder type, and said cam follower is carried by an adapter fixedly secured to an end of said cylinder remote from said movable shaft.

3. A positioning device according to claim 1 wherein said fluid motor is of the piston and cylinder type, and there are spacers at opposite ends of said cylinder mounting said cylinder in said guide sleeve with clearance.

4. A positioning device according to claim 1 wherein there is a bushing mounted between said guide sleeve and said fluid motor.

5. A positioning device according to claim 4 wherein said bushing is connected to said movable shaft for movement with said mounting means relative to both said guide sleeve and said fluid motor.

6. A positioning device according to claim 5 wherein said fluid motor is of the piston and cylinder type, and there are spacers at opposite ends of said cylinder mounting said cylinder in said guide sleeve with clearance.

7. A positioning device according to claim 6 wherein said spacers have bearing surfaces engaging said bushing.

8. A positioning device according to claim 6 wherein said guide sleeve carries internal spacers positioned between said guide sleeve and said bushing and in sliding contact with said bushing.

9. A positioning device according to claim 4 wherein said fluid motor is of the piston and cylinder type, and there are spacers at opposite ends of said cylinder mounting said cylinder in said guide sleeve with clearance.

10. A positioning device according to claim 9 wherein said spacers have bearing surfaces engaging said bushing.

11. A positioning device according to claim 4 wherein said guide sleeve is mounted on said mounting plate by way of a mounting ring seated in said opening, and a seal carried by said mounting ring engaging said bushing in sealing relation.

12. A positioning device according to claim 1 wherein said mounting means includes a support plate, a supply tube carried by said support plate, a further opening in said mounting plate, and said supply tube extending through said further opening in guided relation, said supply tube forming means for preventing rotation of said movable shaft about its axis.

13. A positioning device according to claim 12 wherein there is a bushing seated in said further opening facilitating movement of said supply tube through said further opening in guided relation.

14. A positioning device according to claim 1 wherein said mounting plate and said cam are mounted for relative rotation about an axis parallel to said guide sleeve.

* * * * *